United States Patent [19]

Kallstrom

[11] Patent Number: 4,736,466

[45] Date of Patent: Apr. 12, 1988

[54] PROTECTIVE FACE GUARD

[76] Inventor: Erik C. Kallstrom, 4722 E. Bell Rd., Phoenix, Ariz. 85032

[21] Appl. No.: 31,583

[22] Filed: Mar. 30, 1987

[51] Int. Cl.[4] ..... A61F 9/04

[52] U.S. Cl. ..... 2/9; 2/441; 2/427

[58] Field of Search ..... 2/9, 10, 8, 424, 425, 2/206, 426, 427, 441, 443

[56] References Cited

U.S. PATENT DOCUMENTS

| | | | |
|---|---|---|---|
| 86,1170 | 7/1907 | Gamble et al. | 2/9 |
| 881,957 | 3/1908 | Ridlon | 2/9 |
| 2,125,854 | 8/1938 | Standley | 2/424 |
| 2,525,389 | 10/1950 | Zeller | 2/9 |
| 2,616,081 | 11/1952 | Weaver et al. | 2/9 |
| 3,041,623 | 7/1962 | Glahe | 2/9 |
| 3,220,014 | 11/1965 | Strohm et al. | 2/9 |
| 4,031,564 | 6/1977 | Wood | 2/9 |
| 4,067,065 | 1/1978 | Slosek | 2/10 |

*Primary Examiner*—Peter Nerbun
*Attorney, Agent, or Firm*—Warren F. B. Lindsley

[57] ABSTRACT

This invention relates to a protective face guard employing a grillwork such as used in a catcher's mask and particularly an eye shield which is detachably fastened between a forehead pad and the grillwork for shading the eye of a user.

4 Claims, 1 Drawing Sheet

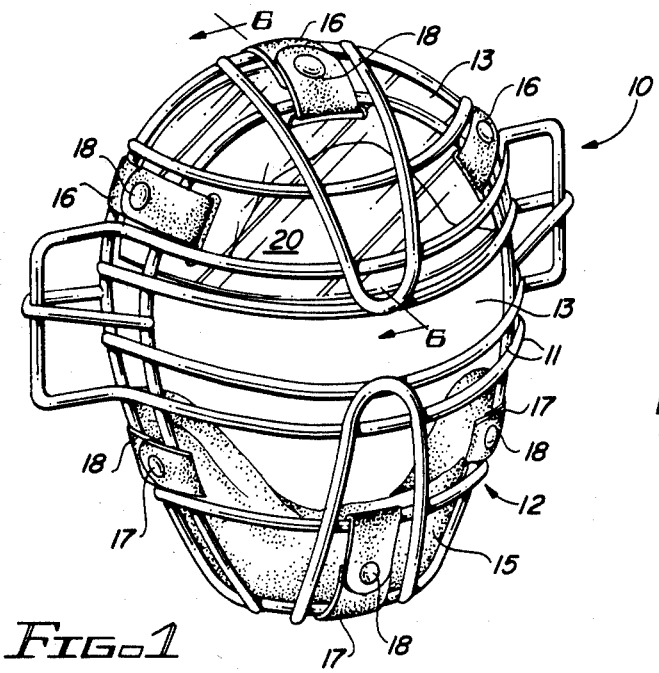
FIG. 1
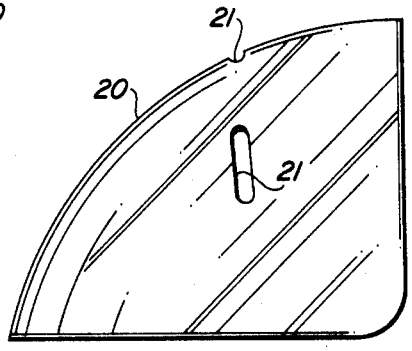
FIG. 5
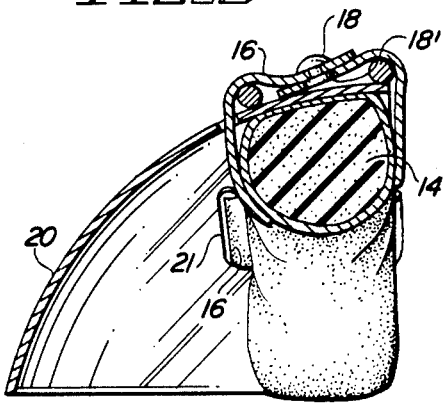
FIG. 6
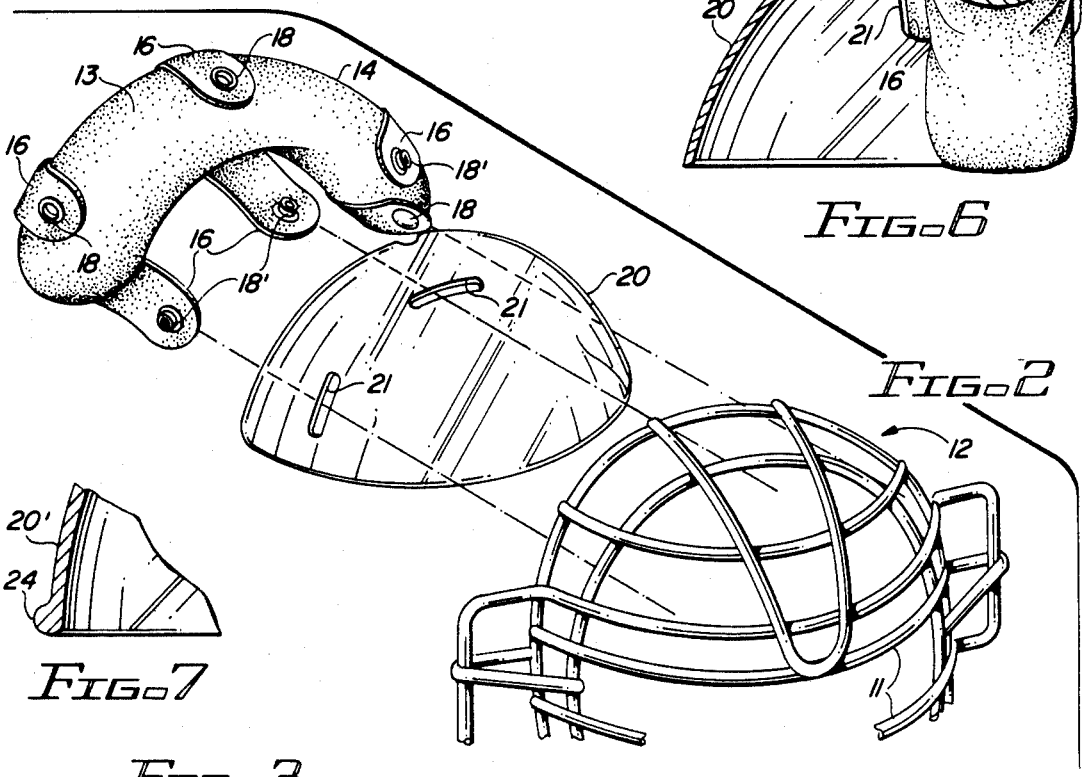
FIG. 2
FIG. 7
FIG. 3
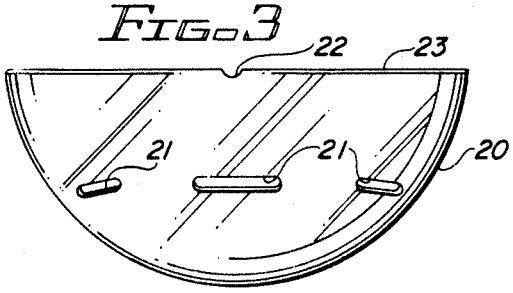
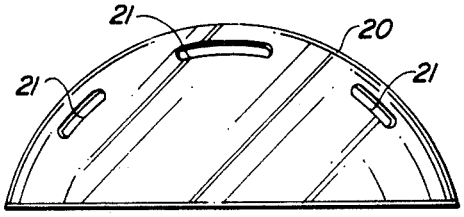
FIG. 4

PROTECTIVE FACE GUARD

BACKGROUND OF THE INVENTION

This invention relates generally to a protective face mask and, more specifically, to a protective face mask employing a new and improved eye shield which can be readily attached and removed therefrom.

PRIOR ART

Although various forms of eye shields have been provided for protective face masks and guards, none have been particularly designed for baseball catcher face masks which may be easily attached and removed therefrom using its forehead pad straps.

U.S. Pat. No. 861,170 discloses a catcher's mask which has a green celluloid eye shield attached thereto.

U.S. Pat. No. 881,957 discloses a catcher's mask having a sunshade which may be pulled down or raised as the need arises.

U.S. Pat. No. 2,525,389 discloses a face guard attached to a football helmet which is provided with a rectangular sight opening and a plurality of breathing apertures below the sight opening.

U.S. Pat. No. 4,031,564 discloses a hockey mask employing a transparent eye shield.

None of these patents disclose the particular type of eye shield set forth herein and, particularly, the means for mounting and removal of it during use in a game.

SUMMARY OF THE INVENTION

In accordance with the invention claimed, an improved protective face mask employing a novel eye shield, therefore, is provided, which eye shield may be readily added to and removed from the face mask using the normally provided straps for an associated forehead pad.

It is, therefore, one object of this invention to provide a new and improved face guard or mask for covering the face of a user and employing a readily removable eye shield.

Another object of this invention is to provide a novel eye shield for a protective face guard such as a baseball catcher's face mask which may be readily removably connected to the mask with straps provided for securing a headband to the mask.

A further object of this invention is to provide an eye shield of arcuate plate form having openings provided therein which cooperate with strap means on a catcher's face mask for removably securing the eye shield to the face mask.

Further objects and advantages of this invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described with reference to the accompanying drawing, in which:

FIG. 1 is a front perspective view of a baseball catcher's mask employing an eye shield and embodying the invention;

FIG. 2 is an exploded view of FIG. 1 illustrating the assembly of the eye shield and forehead pad with the face mask;

FIG. 3 is a top view of the eye shield shown in FIG. 2;

FIG. 4 is a front view of the eye shield shown in FIG. 2;

FIG. 5 is an end view of the eye shield shown in FIG. 2;

FIG. 6 is a cross-sectional view of FIG. 1 taken along the line 6—6; and

FIG. 7 is a partial view of a modification of the eye shield shown in FIGS. 1–6.

DESCRIPTION OF THE PREFERRED EMBODIMENT

Referring more particularly to the drawing by characters of reference, FIG. 1 discloses a face mask such as, for example, a baseball catcher's mask 10 comprising a plurality of wires 11 interconnected into a grillwork assembly 12. Preferably, the metal wires 11 are welded together at intersecting points and then the entire grillwork is coated with a suitable plastic. Defined by the wires 11 are a plurality of apertures or slots 13 that permit the free circulation of air through mask 10, but are of a maximum size that prevents the passage of a conventional baseball therethrough. Preferably, the apertures or slots have a maximum rectilinear spacing between wires of less than two inches.

The mask is of a known configuration having a forehead pad 14 and a chin pad 15 positioned within the mask around portions of its grillwork assembly 12 for bearing on particular portions of the face of the catcher of a baseball team. The grillwork is provided with the usual elastic band which passes around the back of a user's head which is not shown for simplicity purposes.

Both pads 14 and 15 are attached to the grillwork assembly 12 by straps 16 and 17, respectively. These straps are attached at one end to the associated pad and encircle one or more of the wires 11 of the grillwork assembly, and overlap themselves at which point a catch 18, 18' is provided for detachably securing the pad to the grillwork assembly in the manner shown in FIGS. 1 and 2.

In accordance with the teachings of the invention, a sunshade or eye shield 20 is provided which is detachably secured between wires 11 of the grillwork assembly 12 and the forehead pad 14. This eye shade comprises an arcuate shaped thin plate formed of a suitable plastic material, for example, of approximately 0.09 inches thick, and may be formed substantially as a quadrant of a circle. The arcuate piece is provided with three rectangular openings or slots 21 spacedly positioned in a line across the eye shield, each opening or slot being provided for receiving therethrough one of the ends of a strap 16 as it passes around a given wire 11 of the grillwork and back on itself so that the parts of clasp or catch 18, 18' may engage each other, as shown in FIGS. 1 and 2.

This eye shield is intended to shield the eyes of the catcher when needed from the rays of the sun or night lights of an illuminated ballpark, and may be readily added to or removed from the grillwork assembly when needed by merely unclasping catches 18, 18', removing the shield from the grillwork assembly and reclasping catches 18, 18' to again secure the forehead pad to the grillwork assembly.

In order to properly align the eye shield in the grillwork, an alignment notch 22 is formed at the middle of the upper edge 23 of the eye shield, as shown in FIG. 1.

Further, the lower edge of eye shield 20' may be formed with a bead 24 for strength, as shown in FIG. 7, and also to eliminate the possibility of a rough edge.

It should be noted that even though a catcher's mask is shown, the invention is intended to cover any type of face mask for other sports, and the openings through the eye shield may be aligned as shown or out of alignment if so desired.

Although but a few embodiments of the invention have been shown and described, it will be apparent to those skilled in the art that various changes and modifications may be made therein without departing from the spirit of the invention or from the scope of the appended claims.

What is claimed is:

1. A face mask comprising:

an arcuate shaped grillwork for a baseball catcher's mask substantially covering the face of a user, said grillwork defining a plurality of elongated, curved openings sufficiently small to prevent the passage of a ball therethrough, and substantially encompassing the user's field of view, a pad mounted in said grillwork for engaging the forehead of a user, at least a pair of strap means, each comprising a pair of elongated straps spacedly attached at one end to said pad and positioned for partially surrounding a part of said grillwork and detachably engaging each other for holding said pad in place on said grillwork, and a curved shield formed of a flexible transparent plastic material mounted between said pad and said grillwork and extending partially within the user's field of view for shading the eyes of a user, said shield being provided with at least a pair of spacedly arranged slot means with each of said slot means comprising a rectangular configuration spacedly arranged with the other slot means across said shield in a line along the longitudinal axes of the plural slot means extending through said shield, each positioned for receiving therethrough a different one of the straps of said strap means for detachably securing said shield to said grillwork.

2. The face mask set forth in claim 1 wherein:

said grillwork comprises a plurality of wires welded at intersecting points to form said opening, and said grillwork is coated with a plastic material.

3. An eye shield for attaching to the grillwork of a face mask comprising:

an arcuate shaped shield formed of a thin plate-like flexible transparent plastic material forming substantially section of a sphere, said shield being provided with at least a pair of spacedly arranged slot means extending through said shield, and each of said slot means comprising a rectangular configuration arranged with the longitudinal axes of the plural slot means extending their longitudinal axis in a line across said shield and positioned for receiving therethrough a strap for detachably securing said shield to the grillwork of an associated face mask.

4. The eye shield set forth in claim 3 wherein:

said shield is approximately 0.09 inches thick.

* * * * *